US009611990B2

(12) United States Patent
Ellis

(10) Patent No.: US 9,611,990 B2
(45) Date of Patent: Apr. 4, 2017

(54) LIGHT BARS

(71) Applicant: Mary L. Ellis, Boulder, CO (US)

(72) Inventor: Mary L. Ellis, Boulder, CO (US)

( * ) Notice: Subject to any disclaimer, the term of this patent is extended or adjusted under 35 U.S.C. 154(b) by 0 days.

(21) Appl. No.: 15/040,125

(22) Filed: Feb. 10, 2016

(65) Prior Publication Data

US 2016/0161070 A1 Jun. 9, 2016

Related U.S. Application Data

(63) Continuation-in-part of application No. 14/254,188, filed on Apr. 16, 2014, now Pat. No. 9,295,130, (Continued)

(51) Int. Cl.

| | |
|---|---|
| ***F21V 33/00*** | (2006.01) |
| ***H05B 37/02*** | (2006.01) |
| ***F21S 4/28*** | (2016.01) |
| ***H05B 33/08*** | (2006.01) |
| ***A47G 1/02*** | (2006.01) |

(Continued)

(52) U.S. Cl.

CPC ..... *F21S 4/28* (2016.01); *A47G 1/02* (2013.01); *F21V 23/045* (2013.01); *F21V 33/004* (2013.01); *H05B 33/0803* (2013.01); *H05B 33/0806* (2013.01); *H05B 33/0845* (2013.01); *H05B 33/0851* (2013.01); *H05B 37/0227* (2013.01); *H05B 37/0272* (2013.01); *F21S 9/02* (2013.01); *F21V 21/092* (2013.01); *F21V 21/096* (2013.01); *F21W 2131/302* (2013.01); *F21Y 2103/10* (2016.08); *F21Y 2115/10* (2016.08)

(58) Field of Classification Search

CPC ..... F21S 4/28; F21S 9/02; H05B 33/0851; H05B 37/0272; F21V 33/004; F21V 23/023; F21V 23/009; F21V 21/096; F21V 21/008; F21Y 2101/02; F21Y 2103/003

See application file for complete search history.

(56) References Cited

U.S. PATENT DOCUMENTS

| | | | | |
|---|---|---|---|---|
| 6,382,802 B1 * | 5/2002 | Goodman | ..... | A45D 42/16 248/469 |
| 7,048,406 B1 * | 5/2006 | Shih | ..... | A45D 42/10 362/135 |

(Continued)

FOREIGN PATENT DOCUMENTS

| | | | | |
|---|---|---|---|---|
| GB | 2236865 A * | 4/1991 | ..... | G02B 7/1821 |

*Primary Examiner* — Vibol Tan
(74) *Attorney, Agent, or Firm* — William J. Benman; Benman, Brown & Williams

(57) ABSTRACT

A method and system for applying therapeutic stimulation to a patient stricken with paralysis or other condition. The inventive method includes the steps of: inserting an acupuncture needle against the spine of the patient and applying an electrical potential to the needle with a signal that mimics natural neural impulses in the body. The needle is located depending on the nature of the patient's condition. In the illustrative application, the needle is inserted against the ligamentum flavum of the patient's spine at L3. In the best mode, the patient's legs are moved during the application of the electrical potential. The inventive system is adapted to minimize a notch reaction and includes an electrode inserted into a tissue of the patient and a circuit for applying an electrical potential to the electrodes with a signal that mimics natural neural impulses in the body.

20 Claims, 3 Drawing Sheets

Related U.S. Application Data which is a continuation-in-part of application No. 13/134,229, filed on May 30, 2011.

(51) Int. Cl.

| | |
|---|---|
| ***F21V 23/04*** | (2006.01) |
| *F21S 9/02* | (2006.01) |
| *F21V 21/096* | (2006.01) |
| *F21W 131/302* | (2006.01) |
| *F21Y 103/10* | (2016.01) |
| *F21Y 115/10* | (2016.01) |
| *F21V 21/092* | (2006.01) |

(56) References Cited

U.S. PATENT DOCUMENTS

| | | | | |
|---|---|---|---|---|
| 8,256,915 | B2 * | 9/2012 | Stern | A45D 42/10 362/135 |
| 8,880,360 | B2 * | 11/2014 | Mischel, Jr. | A47G 1/02 348/739 |
| 9,122,320 | B1 * | 9/2015 | Rowles | G06F 3/0317 |
| 9,295,130 | B2 * | 3/2016 | Ellis | H05B 33/0896 |
| 2009/0021955 | A1 * | 1/2009 | Kuang | B60Q 3/0259 362/479 |
| 2010/0171606 | A1 * | 7/2010 | Law | B60Q 1/2607 340/468 |
| 2010/0296298 | A1 * | 11/2010 | Martin, Jr. | A45D 42/10 362/311.06 |
| 2012/0051030 | A1 * | 3/2012 | Johnson | F25D 17/042 362/92 |
| 2012/0120080 | A1 * | 5/2012 | Wang | G02B 6/0015 345/520 |

* cited by examiner 10
14
16
18
20
22
24

16
18

22
16

22'

LIGHT BARS

REFERENCE TO RELATED APPLICATION

This is a Continuation-in-Part of copending U.S. patent application Ser. No. 13/134,229, filed May 30, 2011 by M. Ellis and entitled ILLUMINATED MIRROR DESIGN AND METHOD and Ser. No. 14/254,188 filed Apr. 16, 2014 by M. Ellis entitled SYSTEM AND METHOD FOR PROVIDING GRADIENT INTENSITY ILLUMINATION FOR LIGHTED MIRRORS FOR DRESSING ROOMS AND OTHER APPLICATIONS the teachings of both of which are hereby incorporated herein by reference.

BACKGROUND OF THE INVENTION

Field of the Invention

The present invention relates to lighting systems. More specifically, the present invention relates to illumination systems used with mirrors and other applications.

Description of the Related Art

U.S. Patent Application entitled ILLUMINATED MIRROR DESIGN AND METHOD, Ser. No. 13/134,229, filed May 30, 2011 by M. Ellis, the teachings of which have been incorporated herein by reference, addressed the need in the art for an improved illumination system for dressing rooms by providing an elongate rectangular mirror; a first diffuser mounted on a first side of the mirror in parallel relation along a longitudinal axis thereof; a second diffuser mounted on a second side of the mirror in parallel relation along said longitudinal axis; and an array of light emitting diodes mounted along an edge of the first and second diffusers.

The Ellis mirror is a modular integrated mirror and lighting unit or appliance that offers the potential to enhance user perceptions of themselves in (and out of) the clothes they are considering.

What remains is a need in the art for a method and system for retrofitting conventional mirrors with the capability afforded by the Ellis mirror.

SUMMARY OF THE INVENTION

The need in the art is addressed by the light bar assembly for use in combination with a mirror of the present invention. In the illustrative embodiment, the assembly includes a housing; a frame mounted within the housing; one or more light emitting elements mounted on the frame in the housing; a power supply mounted within the housing; a controller mounted within the housing for controlling the light emitting elements; and a transceiver for communicating control signals to the controller.

In the best mode, the light emitting elements are light emitting diodes and the housing includes a diffuser. The controller includes a microprocessor and the transceiver includes a wireless transceiver. Preferably, the controller includes means for effecting gradient light distribution of the light emitting elements.

In a specific embodiment, the assembly further includes a mechanism, such as one or more magnets, for manually attaching the assembly to and manually detaching the assembly from a surface.

The inventive system includes an application adapted to run on a remote computing platform, such as a smartphone, for communicating control signals to the controller.

In an alternative embodiment, an optical sensor mounted in the housing and the controller is programmed with software for self-adjusting the light emitted by the light emitting elements in response to the output from the optical sensor.

In the best mode, the power supply includes a first coil for inductive coupling, a second coil mounted on a surface onto which the assembly is mounted and a rechargeable battery.

DESCRIPTION OF THE INVENTION

Figure 1:
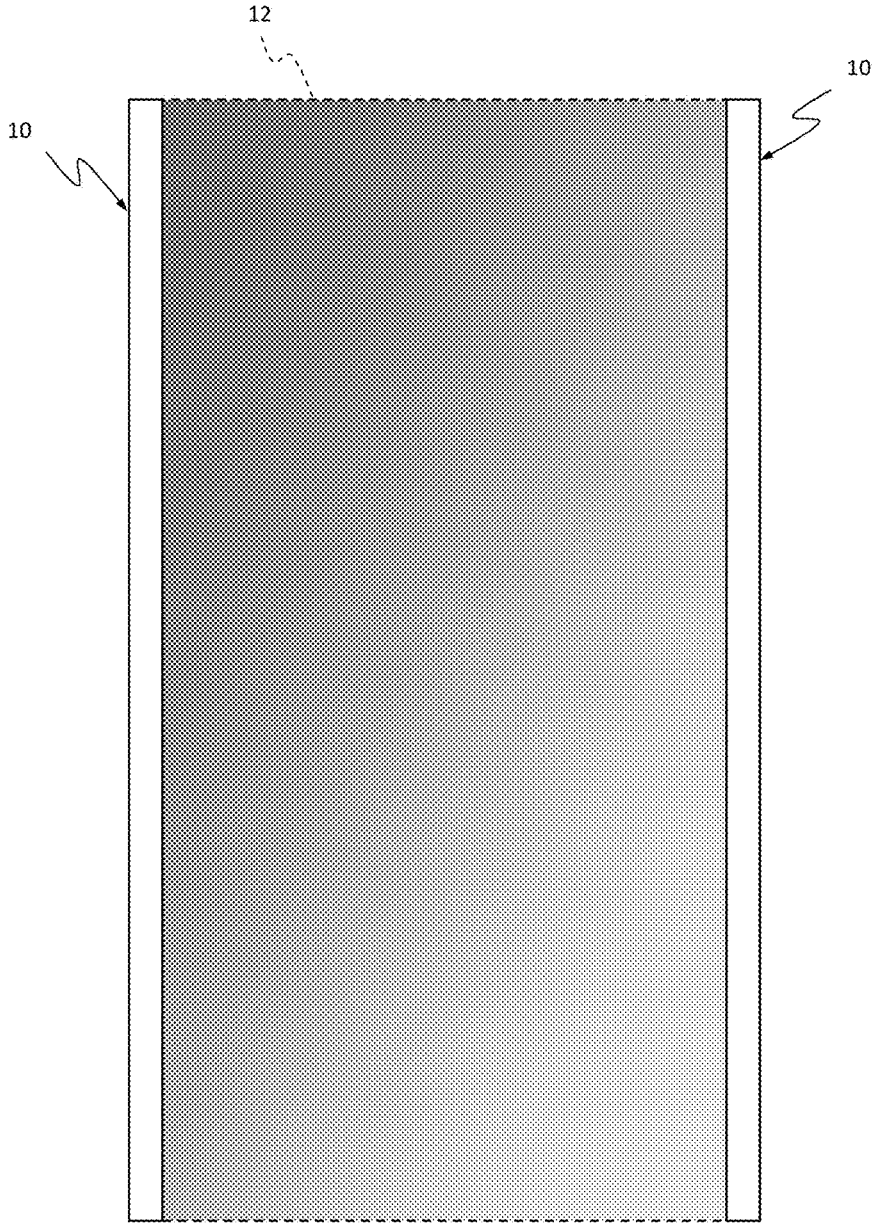
FIG. 1 is a front elevational view of two light bar assemblies of the present invention mounted alongside a conventional mirror shown in phantom.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

As illustrated in the figures and discussed more fully below, the present invention is similar to the Elavue Mirror in basic purpose. The Elavue "LightBars" (or "Bars") are functionally an array of LEDs that can be installed at the sides of an existing mirror to create the same effect as the Elavue Mirror (EVM) in retail dressing rooms, homes, or anywhere mirror illumination needs to be optimized for viewing.

In the most basic embodiment, the Bars are based on the same "flat panel technology" as the panels in the EVM, disclosed and claimed in the above referenced patent applications incorporated by reference herein; i.e., layers of optical material that distribute light evenly throughout an entire illumination surface, coupled with various shatter-proof polycarbonate materials acting as a diffuser and lens covering, with LED chips embedded in channels along the edges of the panels, and a frame surrounding the entire panel, thereby enclosing the LED channels with an attractive and functional housing.

In the illustrative embodiment, there are at least two (2) panels—one for each side of the existing mirror. An additional third panel could be placed across the top of the mirror. The flat panel technology allows a very shallow depth profile (less than 1"), optimal for use next to a mirror that is flat against a wall. The 2 (or more) panels are connected in such a way that they are controlled as a single unit or individually. The color temperature (warm/cool) and intensity (bright/dim) of the light output can be adjusted by the controller as discussed more fully below.

For ease of installation and use by the customer, the mounting system can include an adhesive magnetic material that is placed directly on the wall along the sides of the mirror. The light panels themselves would have corresponding magnetic backing that could then be simply matched and adhered to the adhesive strips. Optimally, the adhesive on the strips is removable, allowing the entire array to be easily repositioned or relocated—an extremely convenient feature since the lifespan of the LED unit is many years. The strips could alternatively be adhered directly ON the mirror's surface, if that is desirable for a given location or situation.

Each of the 2 (or 3) panels is connected wirelessly to each other, allowing for synched control of the unit via wireless remote control, mobile phone, or other device. Currently, Bluetooth technology seems most appropriate for this. The entire unit can be battery-operated.

Most basically, the array can be controlled on/off (Power); warm/cool (CCT); bright/dim (Intensity). The system could also be programmed for any number of needs or desired options; e.g., scheduled operation at specified outputs across various times periods. Additionally, Intelligence can be built in; e.g., the lights could self-adjust to the features (ambient room/wall color, ambient light situation) of the room or space they're installed in, eliminating the need for manual calibration for optimization the lighting output. Along these same lines, the system is programmed so that the lights self-adjust to overall ambient lighting and the coloration (skin tones, clothing colors, etc.) of the person viewing their reflection.

FIG. 1 is a front elevational view of two light bar assemblies of the present invention 10 mounted alongside a conventional mirror 12 shown in phantom.

Figures 2A, 2B, 2C, 2D:
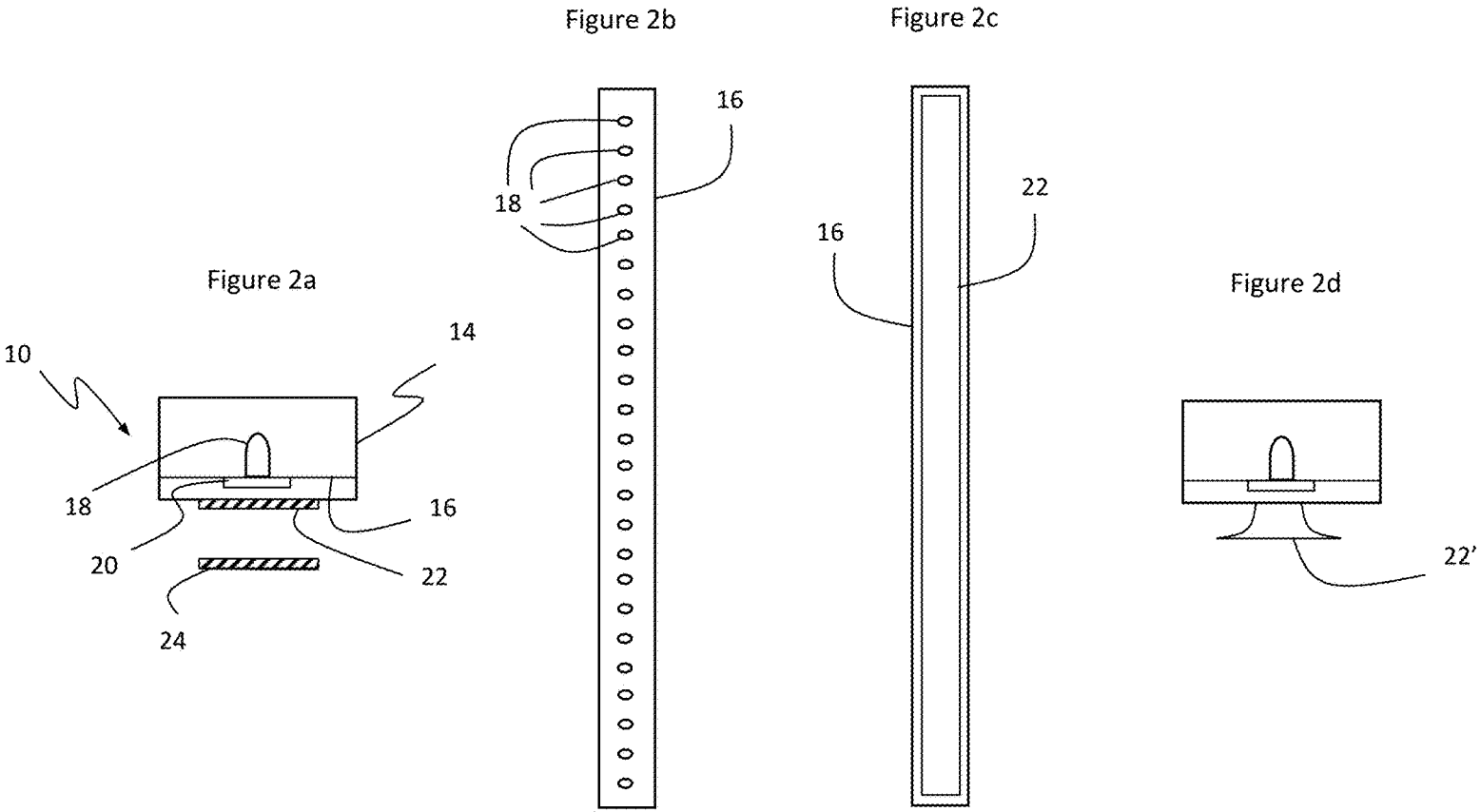
FIG. 2*a* is a sectional end view of a single bar assembly implemented in accordance with the present teachings.
FIG. 2*b* is a front view of single bar assembly implemented in accordance with the present teachings with the housing/diffuser removed.
FIG. 2*c* is a rear view of single bar assembly implemented in accordance with the present teachings.
FIG. 2*d* is a sectional end view of a single bar assembly implemented with mounting cups.

FIG. 2*a* is a sectional end view of a single bar assembly 10 implemented in accordance with the present teachings.

FIG. 2*b* is a front view of single bar assembly implemented in accordance with the present teachings with the housing/diffuser removed.

As shown in FIGS. 1-2*b*, in the illustrative embodiment, the assembly 10 includes a housing 14; a frame 16 mounted within the housing 14; one or more light emitting elements 18 mounted on the frame 16 in the housing 14; an electrical system 20 including a controller 30 mounted within the housing 14 for controlling the light emitting elements 18; a power supply 40 mounted within the housing 14; and a transceiver 50 mounted within the housing for communicating control signals from a user to the controller 30.

In the best mode, the light emitting elements 18 are light emitting diodes and the housing 14 is a diffuser and a lens. The controller 30 includes a microprocessor and the transceiver 50 includes a wireless transceiver and a network interface allowing each bar to be controlled from a simple remote control device or any computing platform from smartphone, tablet, laptop, desktop or server 70 via a local or wide area network or an internet connection. Preferably, the controller 30 includes means for effecting gradient light distribution of the light emitting elements.

Plural rows or arrays of LEDs may be used without departing from the scope of the present teachings. In the illustrative embodiment, the LEDs have a color rendering index (CRI) @ 3000° K=>90. The LEDs should have a color controlled temperature (CCT) range between 2700 degrees Kelvin and 3500 degrees Kelvin.

However, the present invention is not limited to the type or number of LEDs employed. Although one row of LEDs is depicted in the drawing, two or more rows of LEDs may be included in each array on each side of the mirror without departing from the scope of the present teachings. In practice, as LED chip technology evolves, one would select the number, type and size of LEDs to achieve optimal lighting for the intended environment.

In the illustrative embodiment, the output of light at a distance of 4 feet from the center midline of the unit, the light output may vary from an optimal range of 20 fc to 50 fc, as appropriate for the lighting effect desired assuming a user will be standing anywhere from a minimum of two (2) feet to a maximum of approximately seven (7) feet from the unit. This relates to tunability. One of ordinary skill in the art can determine the best setting based on the requirements of a given application.

The diffusers provide illumination surfaces for light distribution and diffusion. The diffusers serve to ensure that light output by the LEDs is evenly and uniformly distributed with no bright or dim areas. In the best mode, the diffuser is a three or four layer composition fabricated of polycarbonate and layers of specialty light dispersion materials and is of a shatterproof construction that remains cool to the touch, even at max output for an extended period of time.

In a specific embodiment, the assembly 10 further includes a mechanism, such as one or more magnets, for manually attaching the assembly to and manually detaching the assembly from a surface. This is illustrated in FIG. 2*c*.

FIG. 2*c* is a rear view of single bar assembly implemented in accordance with the present teachings showing a mounting magnet 22 on the back side thereof. A metallic plate (not shown) may be implanted in a wall or other mounting surface to which the magnet 22 attaches. A coil may be included in the metallic plate and coupled to line current to transmit power to the power supply 40 via inductive coupling via a coil (not shown) coupled thereto. The power supply may include a rechargeable battery.

FIG. 2*d* is a sectional end view of a single bar assembly implemented with mounting cups 22'. This alternative embodiment enables mounting of the bars on a smooth surface such as a window or on the surface of the mirror 12.

Figure 3:
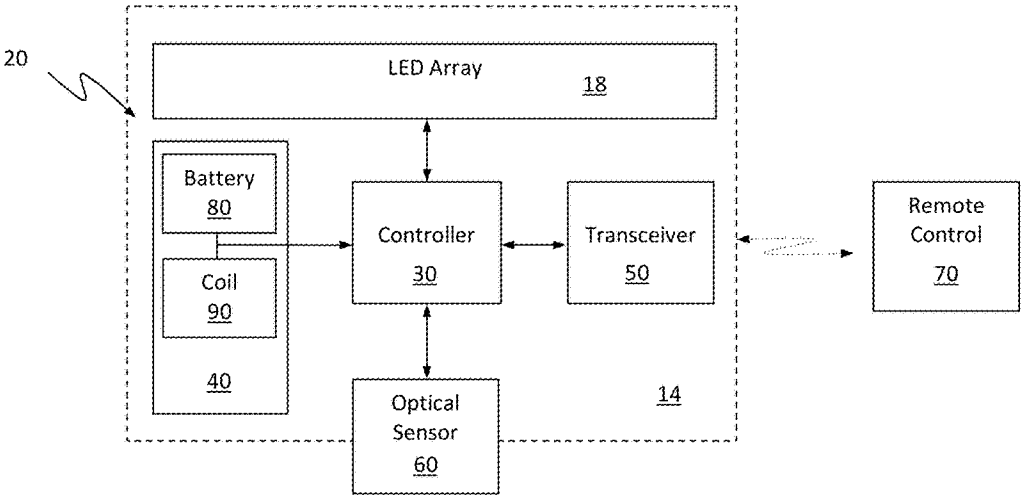
FIG. 3 is a block diagram of an illustrative power and control system for the the light bar assembly of the present invention.

FIG. 3 is a block diagram of an illustrative power and control system for the the light bar assembly of the present invention. As noted above, the electrical system 20 includes a controller 30 that selectively applies power to the LED array 18 from a power supply 40 based on controls received through a transceiver from a user via a remote control unit or computing platform 70. The inventive system includes an application adapted to run on the remote computing platform, such as a smartphone, for communicating control signals to the controller and/or providing other features.

An optical sensor 60 may be included in the electrical system 20 and mounted on or in the housing. In this embodiment, the controller 30 and the remote platform (not shown) include software for self-adjusting the light emitted by the bar in response to the output from the optical sensor and/or an illumination profile selected by the user.

As shown in FIG. 3, in the best mode, the power supply 40 includes a battery 80. Preferably, the battery 80 is rechargeable. In this case, an optional inductive charging coil 90 is included to charge the battery 80.

The present invention has been described herein with reference to a particular embodiment for a particular application. Those having ordinary skill in the art and access to the present teachings will recognize additional modifications, applications and embodiments within the scope thereof. For example, the invention is not limited to the number of illumination elements used or the type thereof. The light elements can be other shapes including square, rectangular, circular, irregular, etc. without departing from the scope of the present teachings. The invention is not limited to use in dressing room applications.

It is therefore intended by the appended claims to cover any and all such applications, modifications and embodiments within the scope of the present invention.

Accordingly,

What is claimed is:

1. A light bar assembly for use in combination with a mirror consisting of:

a housing;

a frame mounted within the housing;

an elongate linear array of light emitting elements mounted on the frame in the housing effective to provide a light output in the range of 20 to 50 foot-candles at a range of 2 to 7 feet;

a lens mounted on said housing for distributing light from said array evenly throughout an entire illumination surface;

a power supply mounted within the housing; and a controller mounted within the housing for controlling the light emitting elements.

2. The invention of claim 1 wherein the lens serves as a diffuser.

3. The invention of claim 1 further including a mechanism for manually attaching the assembly to and manually detaching the assembly from a surface.

4. The invention of claim 3 wherein the mechanism for manually attaching and detaching includes a magnet affixed to the surface or to the housing.

5. The invention of claim 4 further including magnets for securing the assembly to the mirror.

6. The invention of claim 1 further including a stand for mounting the assembly on a floor.

7. The invention of claim 1 further including a line for hanging the assembly from a ceiling.

8. The invention of claim 1 wherein the light emitting elements are light emitting diodes.

9. The invention of claim 1 wherein the controller includes means for effecting gradient light distribution of the light emitting elements.

10. The invention of claim 1 wherein the controller includes a microprocessor.

11. The invention of claim 1 further including a wireless transceiver disposed within said housing and coupled to said controller.

12. The invention of claim 11 wherein said transceiver is a Bluetooth transceiver.

13. The invention of claim 1 further including an application adapted to run on a remote computing platform for communicating control signals to said controller.

14. The invention of claim 1 further including an optical sensor mounted in said housing.

15. The invention of claim 14 wherein said controller includes software for self-adjusting the light emitted by said bar in response to the output from the optical sensor.

16. The invention of claim 1 wherein the power supply includes a coil for inductive coupling.

17. The invention of claim 16 wherein the power supply includes a rechargeable battery.

18. The invention of claim 16 further including a second coil mounted on a surface onto which said assembly is mounted.

19. A light bar assembly for use in combination with a mirror consisting of:

a housing;

a frame mounted within the housing;

an elongate linear array of light emitting elements mounted on the frame in the housing effective to provide a light output in the range of 20 to 50 foot-candles at a range of 2 to 7 feet;

a lens mounted on said housing for distributing light from said array evenly throughout an entire illumination surface;

a power supply mounted within the housing;

a controller mounted within the housing for controlling the light emitting elements; and a wireless transceiver for communicating control signals to the controller.

20. A light bar assembly for use in combination with a mirror consisting of:

a housing;

a frame mounted within the housing;

an elongate linear array of light emitting elements mounted on the frame in the housing effective to provide a light output in the range of 20 to 50 foot-candles at a range of 2 to 7 feet;

a lens mounted on said housing for distributing light from said array evenly throughout an entire illumination surface;

a power supply mounted within the housing, said power supply including a rechargeable battery and a coil for inductive coupling;

a controller mounted within the housing for controlling the light emitting elements;

an optical sensor mounted within said housing; and a mechanism, coupled to said controller, for adjusting the light emitted by said bar in response to the output from the optical sensor.

* * * * *